US005156398A

United States Patent [19]

Kibamoto

[11] Patent Number: 5,156,398

[45] Date of Patent: Oct. 20, 1992

[54] GOLF MAT

[76] Inventor: Hiroji Kibamoto, 1-1-4 Hirayama, Hino-shi, Tokyo, Japan

[21] Appl. No.: 833,352

[22] Filed: Feb. 10, 1992

[30] Foreign Application Priority Data

May 22, 1991 [JP] Japan ..... 3-45487

[51] Int. Cl.[5] ..... A63B 69/36

[52] U.S. Cl. ..... 273/187.1; 273/195 A; 273/176 J

[58] Field of Search ..... 273/176 J, 34 B, 35 B, 273/195 A, 195 B, 200 B, 196, 197 R, 197 A, 198, 176 H, 183 A

[56] References Cited

U.S. PATENT DOCUMENTS

| | | | |
|---|---|---|---|
| 3,633,917 | 1/1972 | Anderson | 273/195 A |
| 3,693,979 | 9/1972 | Koett | 273/195 A |
| 3,712,628 | 1/1973 | Boss | 273/195 A |
| 5,046,741 | 9/1991 | Ahn | 273/195 A |

*Primary Examiner*—George J. Marlo

*Attorney, Agent, or Firm*—Koda and Androlia

[57] ABSTRACT

A golf mat including a base mat with a circular recess having an artifical turf at the bottom, a circular driving mat which has an artificial turf on its top surface and is rotatably fitted in the circular recess of the base mat by a pin, and an auxiliary plate installed under the driving mat. Each time a ball is hit off the driving mat, the driving mat rotates so that the entire surface of the driving mat is used evenly.

4 Claims, 3 Drawing Sheets

GOLF MAT

BACKGROUND OF THE INVENTION

1. Field of the Invention

The present invention relates to a golf mat which is used for golf practice.

2. Prior Art

Generally, a golf mat uses an artificial turf installed on a rectangular base plate. If such a golf mat is not fixed on the ground, the mat moves in the direction of the swing each time the golf club strikes the mat when hitting a ball. Therefore, it is necessary to repeatably correct the position of the mat and this is troublesome. On the other hands, if the mat is fixed on the ground, the mat does not move when a mis-shot, for example, "a fat shot" is made. If this happens, the shock of the drive is transmitted directly to the wrists, elbows, shoulders, etc; and may cause problems such as tendinitis, etc.

Furthermore, the position of the ball when hit generally tends to be concentrated in the central area of the mat. As a result, heavy use causes an excessive abrasion of the artificial turf at the center of the mat.

Some golf mats recently marketed have driving surfaces of a circular or polygonal shape so that the driving surfaces can be rotated when a ball is hit. Examples are described in the Japanese Utility Model Application Laid-Open No. 63-100075 and the Japanese Utility Model Application Publication No. 60-13499.

According to the mat disclosed in the Laid-Open No. 63-100075, the shock-buffering effect is improved. However, the mat bounds each time a ball is hit since the artificial turf is installed also on the side of the mat which contacts the ground. In addition, if the mat is placed on soft ground, for example, sandy soil, the artificial turf installed on the mat bites into the ground, so that the mat does not rotate well. Furthermore, it is not possible to adjust the degree of rotation of the mat.

On the other hand, according to the mat disclosed in Publication No. 60-13499, the driving surface of the mat can be replaced when the artificial turf of the mat is worn out. However, to replace the mat is difficult and must be performed by hands. In addition, there are several other problems; for example, the ability of the mat to reduce the shock caused by driving is not good enough to prevent physical problems such as tendinitis.

SUMMARY OF THE INVENTION

The object of the present invention is to provide a golf mat which can be placed on the ground without regard to the condition of the ground, reduced any shock transmitted to the wrists, elbows, shoulders or waist of a golfer during the golf practice, makes it possible to avoid excessive abrasion of any given portion of the artificial turf, and also makes it possible to adjust the rate of rotation of the driving mat in accordance with the driving position and the degree of skill of the golfer.

In order to achieve the object described above, the golf mat of the present invention is equipped with (a) a base mat provided with a circular recess which has an artificial turf installed on the bottom surface, (b) a disk-form driving mat whose diameter is smaller than the circular recess, and which has an artificial turf installed on its top surface, and (c) an auxiliary plate which has the same diameter as the driving mat or a smaller diameter than the driving mat. The driving mat and the auxiliary plate are rotatably provided in the circular recess of the base mat by a pin. Therefore, the driving mat can be rotated when the ball is hit and easily removed by pulling out the pin when it is worn out.

DETAILED DESCRIPTION OF THE INVENTION

Figure 1:
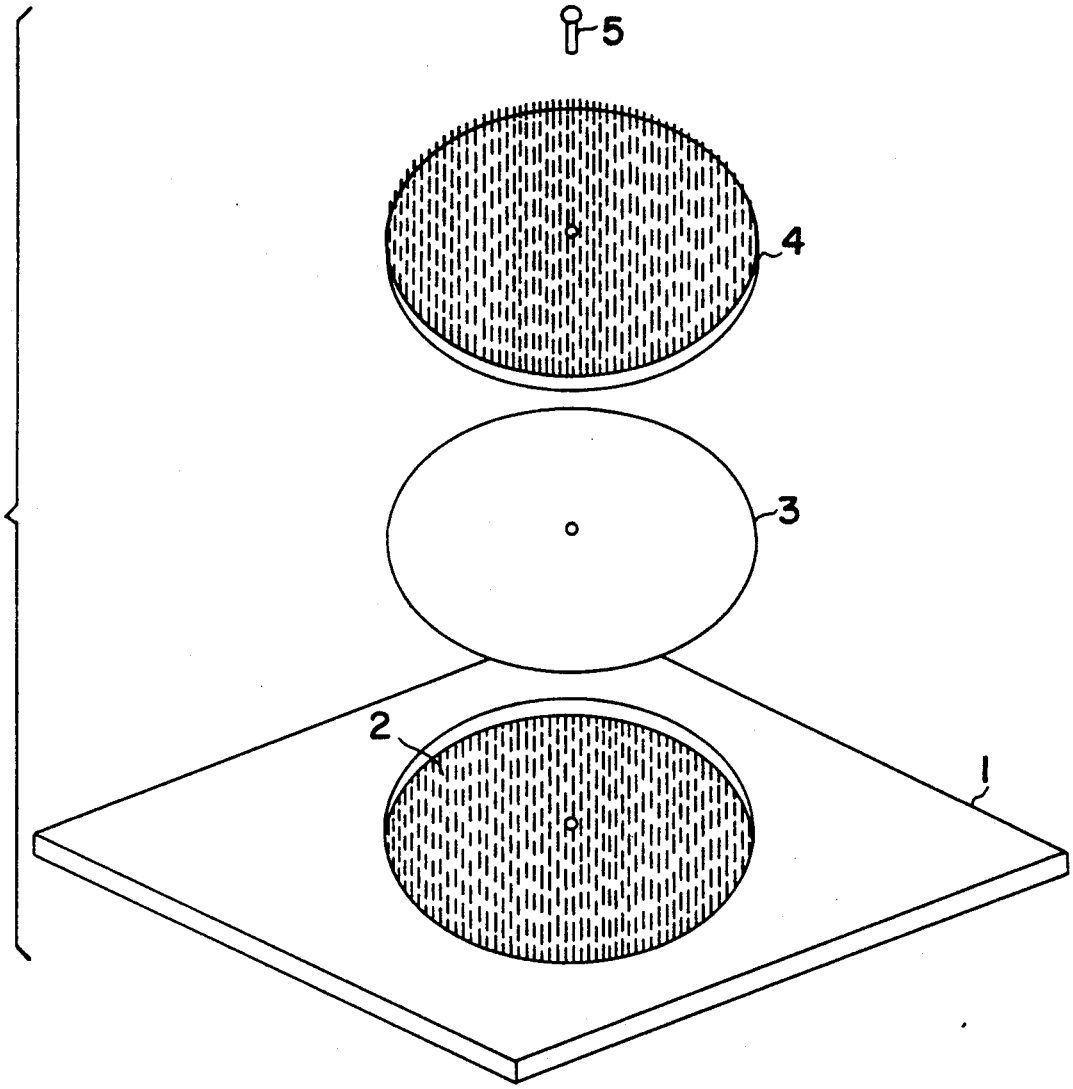
FIG. 1 is a perspective view illustrating each component of the golf mat of the present invention.
Figure 2:
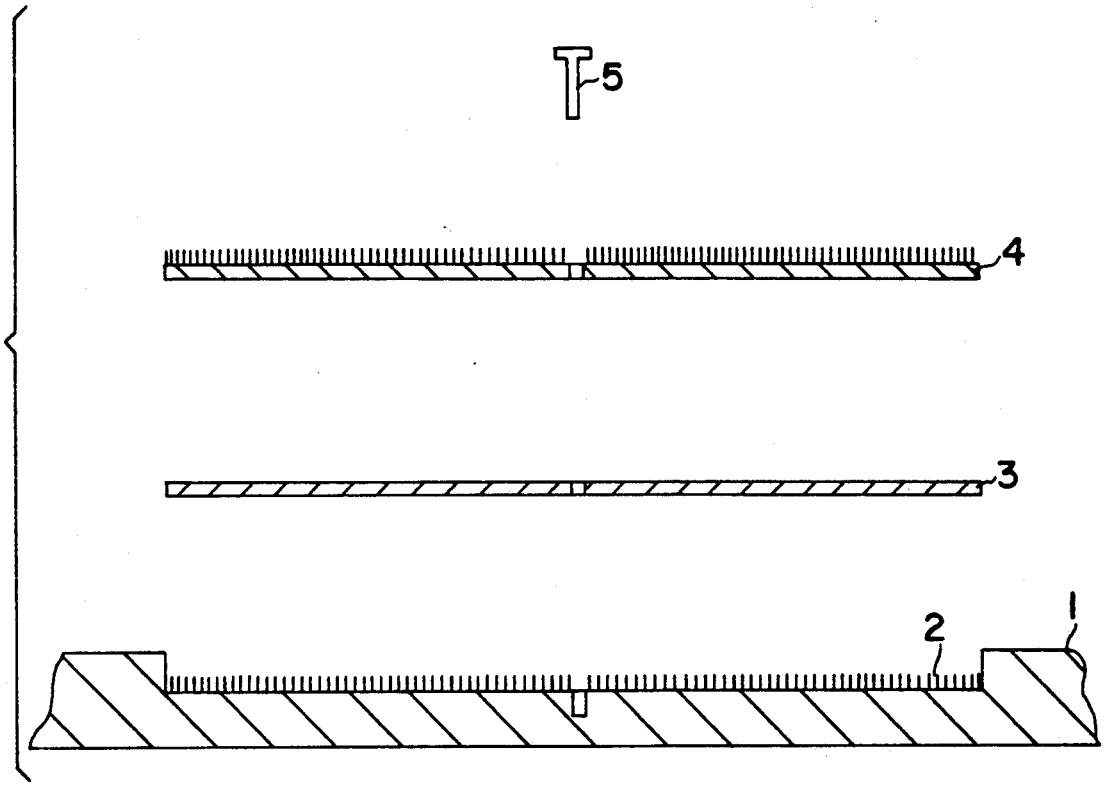
FIG. 2 is a cross sectional view thereof.

An embodiment of the present invention will be described below with reference to FIGS. 1 and 2.

A golf mat of the present invention is comprised of a base mat 1 which has a circular recess 2 at the center, an auxiliary plate 3, a driving mat 4, and a pin 5. An artificial turf is provided on the bottom surface of the circular recess 2 and the top surface of the driving mat 4 respectively.

There are no particular restrictions to the material used for the base mat 1. However, from the standpoint of obtaining good contact with the ground, it is desirable to use a hard rubber, etc., which has an appropriate weight.

The auxiliary plate 3 is a thin circular plate which has the same as or smaller diameter than the circular recess 2, so that the plate 3 can be fit in the recess 2. There are no particular restrictions to the material used for the auxiliary plate 3, as long as the material is appropriately smooth. In the present embodiment, a thin plate made of a synthetic resin (polyethylene, hard plastic, etc.) is used.

The driving mat 4 is a disk-form mat which is smaller in diameter than the circular recess 2, so that the mat 4 can be fit in the recess 2. It is desirable that the material used for the driving mat 4 is a hard rubber, a synthetic resin, etc., which has an appropriate elasticity.

An artificial turf is installed on the surface of the driving mat 4. The material of the artificial turf may be the same as that of the artificial turf installed in the circular recess 2, for example, chemical fibers.

Furthermore, holes which are used to connect the base mat 1, the auxiliary plate 3 and the driving mat 4 by a pin 5 are formed in the central portions of each component.

When the golf mat is used, the driving mat 4 is set in the circular recess 2 with the auxiliary plate 3 which is interposed between the driving mat 4 and the base mat 1, and these components are fastened together at the central portions by the pin 5 so that the driving mat 4 can rotate relative to the base mat 1, and so that the driving mat 4 can be removed from the base mat 1.

In actual practice, the golf mat of the present invention is first placed in a golf practice range or a private yard after all components are fastened together by the pin 5. When the golf mat is placed on the ground, it is not necessary to fix the base mat 1 to the ground surface since the golf mat of the present invention has an appropriate weight so as not to be moved by practice driving.

In an example a golfer stands in an appropriate position behind the base mat 1 and places a golf ball in a desired position on the surface of the artificial turf of the driving mat 4. The golfer then hits the ball. In this case, the impact of the club head is absorbed by the artificial turf of the driving mat 4 and is also released by the rotation of the driving mat 4. Accordingly, the shock transmitted to the wrists, elbows, shoulders, waist, etc., of the golfer is diminished.

In the present invention, the shock-absorbing effect is increased since the artificial turf is also installed on the bottom surface of the circular recess 2. In addition, since the auxiliary plate 3 which has an appropriate degree of smoothness is installed between artificial turf of the circular recess 2 and the driving mat 4, the driving mat 4 can be rotated smoothly. Furthermore, the driving position can shift as the driving mat 4 rotates. As a result, there would occur no excessive abrasion of any given portion of the artificial turf. Thus, the entire surface of the artificial turf on the driving mat 4 can be used evenly. Moreover, in the present invention, the auxiliary plate 3 and the driving mat 4 can be removed from the base mat 1; accordingly, when the artificial turf on the driving mat 4 has become worn out, it is necessary to replace only the driving mat 4. Thus, it is economical.

Furthermore, the amount of the rotation of the driving mat 4 can be adjusted by increasing or decreasing the size of area of the undersurface of the auxiliary mat which contacts the artificial turf in the circular recess 2. In other words, the degree of the rotation of the driving mat 4 can be controlled by replacing the auxiliary plate 3.

Figure 3:
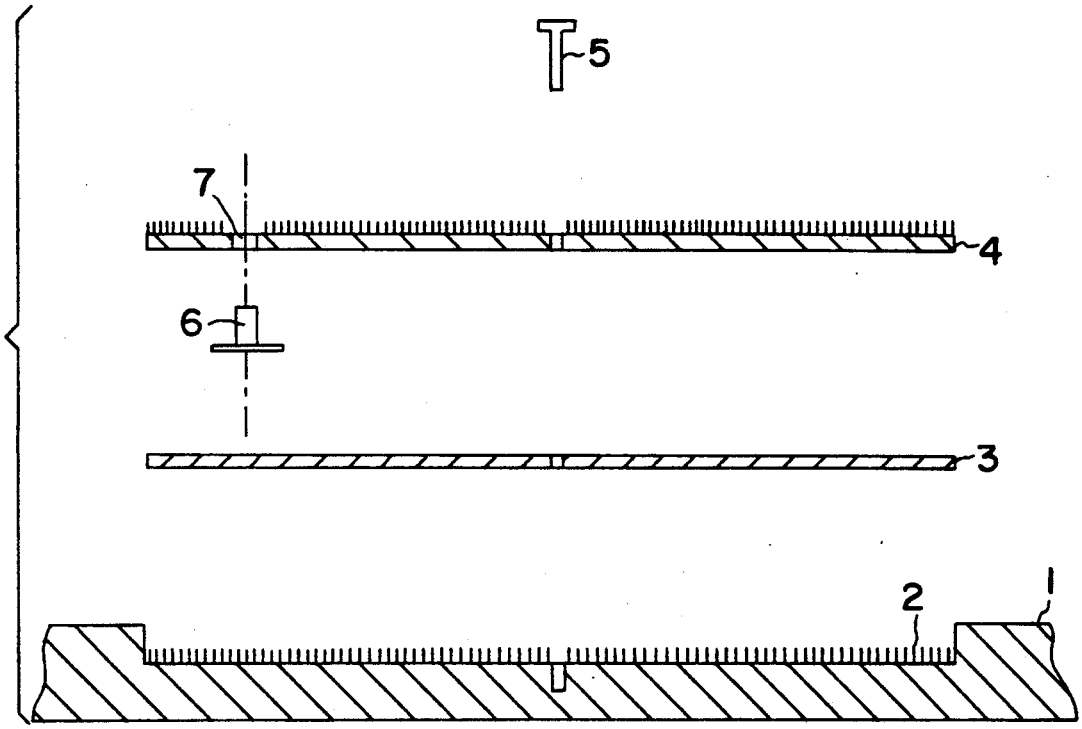
FIG. 3 is a cross sectional view of the golf mat with a rubber tee installed.

In addition, as shown in FIG. 3, it is possible to provide a rubber tee 6 used for a practice of driver between the undersurface of the artificial turf mat 4 and the top surface of the auxiliary plate 3 so that the top of the tee 6 sticks out of the mat 4 through a tee hole 7. The tee hole 7 can be made two or more, so that a plurality of tees 6 are set in the mat 4.

As described above, the present invention uses the base mat 1 which has the circular recess 2 whose bottom surface is covered with artificial turf, and the base mat 1 and the driving mat 4 are fastened together by the pin 5 with the smooth-surface auxiliary plate 3 interposed between the base mat 1 and the driving mat 4. Accordingly, the installation is easy and the shock-absorbing effect is extremely superior. Furthermore, since the driving mat is replaceable, it is economical. In addition, the present invention makes it possible to provide, at a low cost, a golf mat in which the amount of rotation of the driving mat can be adjusted as desired.

I claim:

1. A golf mat characterized in that said mat consists of a base mat which has a circular recess formed therein and an artificial turf installed on the bottom surface of said circular recess, a disk-form driving mat which is smaller in diameter than said circular recess and has an artificial turf installed on its surface, and an auxiliary plate which has the same or smaller diameter compared to said driving mat, and in that said driving mat is provided in said circular recess with said auxiliary plate interposed between said driving mat and said circular recess, and said driving mat is connected to said base mat so as to be rotatable relative to said base mat and removable from said base mat via a pin which passes through holes formed in the central portions of said driving mat, auxiliary plate and base mat.

2. A golf practice mat comprising:

a base mat having a circular recess with an artificial turf provided on the surface of said circular recess, said base mat having a hole at the center of said circular recess;

a disc-form driving mat with a center hole and an artificial turf provided on a top surface thereof, said driving mat having a smaller diameter than that of said circular recess;

an auxiliary plate with a center hole; and a pin which passes through said holes of said driving mat and auxiliary plate and fits in said hole of said base mat so that said driving mat with said auxiliary plate underneath can be rotated in said circular recess of said base mat.

3. A golf practice mat according to claim 1 wherein at least one tee hole is provided in said driving mat so that a tee is installed therein.

4. A golf practice mat according to claim 2 wherein at least one tee hole is provided in said driving mat so that a tee is installed therein.

* * * * *